United States Patent [19]

Thomas

[11] 4,162,004

[45] Jul. 24, 1979

[54] CARRYING CASE

[75] Inventor: William E. Thomas, Bartlesville, Okla.

[73] Assignee: Phillips Petroleum Company, Bartlesville, Okla.

[21] Appl. No.: 865,142

[22] Filed: Dec. 28, 1977

[51] Int. Cl.[2] ..... B65D 85/54; A45C 11/26

[52] U.S. Cl. ..... 206/349; 220/339; 206/317; 206/521

[58] Field of Search ..... 30/151, 381; 206/14, 206/314, 317–320, 349, 372, 482–483, 521, 560, 565, 576; 224/2 F

[56] References Cited

U.S. PATENT DOCUMENTS

| | | | |
|---|---|---|---|
| 1,674,352 | 6/1928 | Adams | 206/317 |
| 2,788,889 | 4/1957 | Turnbow | 206/349 X |
| 2,969,140 | 1/1961 | Avetta | 206/349 |
| 3,259,232 | 7/1966 | Elson et al. | 206/349 |
| 4,079,880 | 3/1978 | Edwards | 220/339 X |

FOREIGN PATENT DOCUMENTS

| | | | |
|---|---|---|---|
| 961813 | 1/1975 | Canada | 206/317 |
| 719892 | 11/1966 | Italy | 206/317 |

*Primary Examiner*—Davis T. Moorhead

[57] ABSTRACT

A carrying case is made, preferably molded of hard plastic, having within the same, preferably as integral part thereof a stop, lug or block to arrest motion of a carried object by coacting with a portion of said object as the object is urged toward and against said stop by an inclined plane or surface generally facing toward said stop and coacting with another portion of said object. The plane or surface can be comprised in an upstanding outcropping or rib. The surface or rib can have in the surface an offset, jog or crotch generally facing said stop to limit motion away from said stop whenever the inclined surface is insufficient to urge the object towards said stop as when the case is tilted to render the inclined surface momentarily inoperative and when the top of the closed case may not urge the carried object toward said plane.

Providing several spaced offsets permits the case to effectively accommodate several sizes of objects, e.g., chain saws of different models or sizes.

If desired, the or a similar inclined surface in the top of the case will provide an urging of the object toward the stop. Thus, there can be such a surface in the bottom or in the top or in both top and bottom of the case. For chain saw use the stop coacts, e.g., as a bay-shaped element or stall with the gripping teeth of the saw.

A snap-into-place integrally molded hasp coacts with a wedge portion to lock the top of a case to the bottom thereof, in one embodiment.

17 Claims, 4 Drawing Figures

CARRYING CASE

This invention relates to a case for carrying an object within the same. Further it relates to a carrying case in which an object is held in a specific, desired position. Further, in one of its aspects, the invention relates to a carrying case elements of which coact to position and to hold in position a carried object. Still further, the invention relates to a carrying case adapted to carry different models or sizes of objects, e.g., chain saws. Still further, the invention relates to a molded carrying case, suited for carrying chain saws, in which chain saws of different models or sizes can be carried without motion of the saw. Also, the invention relates to a molded hinged carrying case, suited for chain saws, having integrally-molded closure means.

In one of its concepts the invention provides a carrying case having, protruding into the inner space of the same, a combination of elements at least one element of which arrests motion of a carried object while another element of which urges the carried object toward said one element. In another of its aspects the invention provides a carrying case, preferably molded of a hard plastic, having within the same and protruding into the space enclosed thereby a stop, lug or block adapted to arrest motion of a carried object by coacting with a portion of said object as that object is urged toward and against said stop by its own weight resting on an inclined plane or surface generally facing toward said stop and coacting with a portion of the carried object to urge the object toward said stop.

In a further concept of the invention the plane or surface can be comprised in an upstanding, outcropping or rib. The surface or rib is preferably shaped or molded to exhibit an offset, jog or crotch generally facing the stop to limit motion away from said stop whenever the inclined surface is insufficient to urge the object toward said stop as when the case is tilted to render the inclined surface momentarily inoperative and whenever for some reason the top of the case in closed position may not urge the carried object toward said inclined plane. In a further concept of the invention it provides in the bottom of the carrying case in upright position a combination of a stop and inclined plane, which can be shaped to exhibit an offset, jog or crotch as herein described. In a further concept of the invention the inclined plane still generally facing the stop is positioned in the top of the carrying case so that in closed position it will urge the carried object toward said stop. In a more specific concept at least one inclined plane can be provided in the bottom as well as in the top of the carrying case to secure the object in a desired position within the carrying case enclosed space.

In a still further concept of the invention it provides a snap-into-place integrally molded hasp designed to coact with a wedge portion to lock the top of the case to the bottom thereof—in an embodiment the hasp being at the swinging edge of the top portion and being positioned further to encompass a wedge shape portion of the top edge of the bottom of the case provided at its edge, the wedge shaped portion being substantially triangularly shaped with the apex edge of the triangle facing the oncoming hasp and the base of the triangle forming a shoulder behind which the bail portion of the hasp is snapped following its being bent by the motion of the bail against the plane of the wedged portion.

It is desirable to provide a carrying case for objects, especially objects which are not only delicate in nature as in the instance of a chain saw the chain of which must be kept sharp and undamaged. Further, it is desirable to provide a case which will effectively position and keep in position within the case an object which if it should move within the case, may damage the same as in the case of a chain saw, the chain of which carries very sharp teeth which upon repeated motion against the wall of the case could puncture the same and possibly injure a person or object outside the case as it is being carried or moved against. It is preeminently desirable to produce or mold a carrying case for objects, e.g., chain saws, having different sizes or model configurations so that, in effect, one model carrying case will effectively, without more, carry any one of several different models or sizes of objects, e.g., chain saws.

A carrying case for a chain saw having grooves and fastening straps therein is disclosed in U.S. Pat. No. 2,788,889 issued Apr. 16, 1957.

An object of this invention is to provide a carrying case. Another object of the invention is to provide a carrying case in which a carried object is guided, received into and carried in a fixed position. Another object of the invention is to provide a carrying case adapted to carry different models or sizes of the same or similar objects. A further object of the invention is to provide a carrying case for an object of delicate nature, e.g., a chain saw, the teeth of the chain of which are to be protected. A further object of the invention is to provide a carrying case adapted to fit more than one size chain saw.

Other aspects, concepts, objects and the several advantages of the invention are apparent from a study of this disclosure, the drawing and the appended claims.

According to the present invention, there is provided a case adapted to receive and to store an object within it in a fixed position, thus preventing undesirable motion of that object in said case, which comprises in said case a stop, lug or block protruding from a wall of said case into its interior so positioned and adapted as to coact with a portion of said object that motion of that object toward said block is arrested when said portion of said object is in contact with a portion of said block, and an inclined surface within the interior of said case removed from said stop to provide between said surface and said stop a space to receive at least a portion of said object, said surface facing said portion of said stop and being otherwise so positioned and adapted as to coact with another portion of said object to urge it by virtue of its weight upon said inclined surface toward said portion of said stop.

Further according to the invention the stop is provided in the bottom of the case and the inclined surface is formed by at least one upstanding, outcropping member or rib.

Still further according to the invention to accommodate more than one size of the same or similar type of object one or more provided ribs can be formed having an offset, jog or crotch therein, thus adapting it to coact with a similar portion of the carried object which is formed complementarily to fit against said offset, jog or crotch.

More specifically, according to the invention, the stop or block or lug, as the case may be, can be formed variously to fit into or around or to coact with a portion of the carried object. Thus, in the case of a chain saw the stop member can be formed in the shape of a stall which will substantially espouse or surround at least one of the gripping teeth of the chain saw.

Further, according to the invention the carrying case which is molded is adapted to enclose and to carry an object therein and comprises a generally convex, molded top, and a generally concave, molded bottom, said top and bottom being hinged together one of said top and bottom having molded integrally therewith and extending from its swinging edge to overlap the corresponding edge of the other of said top and bottom a hasp of size and configuration adapting it to be deformed to an extent and to espouse a shoulder provided near the edge of the other of said top and bottom, the other of said top and bottom being provided at its edge which is overlapped by said hasp at the place of said hasp overlap to coact with said hasp to retain closed said case with a generally triangularly shaped wedge, the apex edge of which faces the edge of said other of said top and bottom which is provided with said hasp, the base of said wedge forming a hasp retaining shoulder, the face of the wedge being of an angle suitable to cause the hasp to be deformed and to slide thereover, the hasp and wedge being sized so that when the case is closed the bail of the hasp is snapped into case-closing, hasp-retaining relationship with said shoulder.

Referring now to the drawing.

Figure 1:
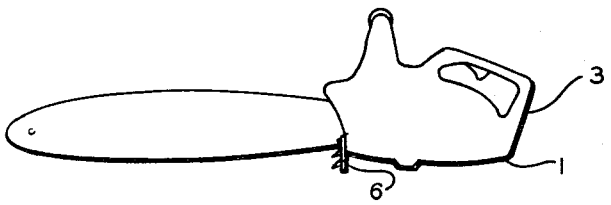
FIG. 1 shows a conventionally available chain saw. The portion of the chain saw body at 1 is noted for further reference.
Figure 2:
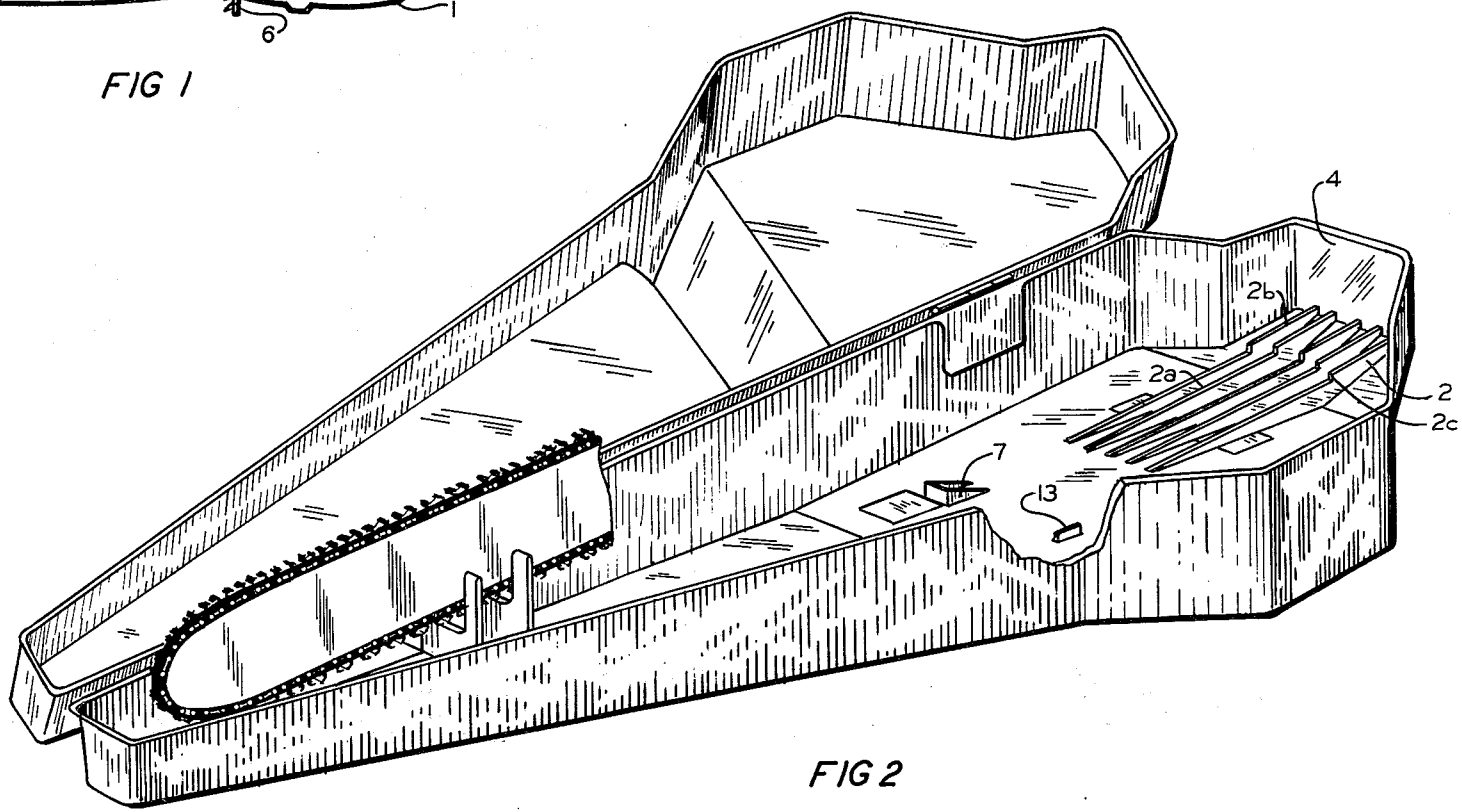
FIG. 2 shows an isometric view of the inside of a carrying case according to the invention.

Referring now to FIG. 2 there is shown at 2 and 2*a*, an isometric view, upstanding rib 2 having inclined surfaces 2*a* and 2*b* and jog 2*c* formed therein. Portion 1 of the chain saw body, earlier mentioned, will, depending upon the size of the chain saw, espouse or fit against incline 2*a* or 2*b*. In the event the chain saw is the largest size accommodated by the carrying case, the back end of chain saw 3, FIG. 1, formed by a plane at an angle to the plane shown at 1, will fit against wall 4, FIG. 2, of the carrying case. Plane 1 of the chain saw body will lie on incline 2*b*.

However, for a smaller sized chain saw plane 1 will fit against surface 2*a* and plane 3 will fit against offset 2*c*.

Whichever size chain saw is placed in the container at least one of the gripping teeth 6 will be forced into stall 7 which acts as a stop thus to prevent the chain saw from moving forward in the case and abutting the chain against the wall of the case. Centering lug 13 assists in holding said chain saw in position.

It will be obvious to one skilled in the art studying this disclosure that the relative positions of the ribs and stall 7 are adjusted to fit the particular saws and sizes to be carried.

Depending upon the size and configuration of the chain saw body or of other object to be carried in a case according to the invention, there will be provided a multiplicity of ribs in which the jogs or offsets can be at the same or at different distances from the stop or stall 7, or, alternatively, from the wall 4 of the case.

Figure 4:
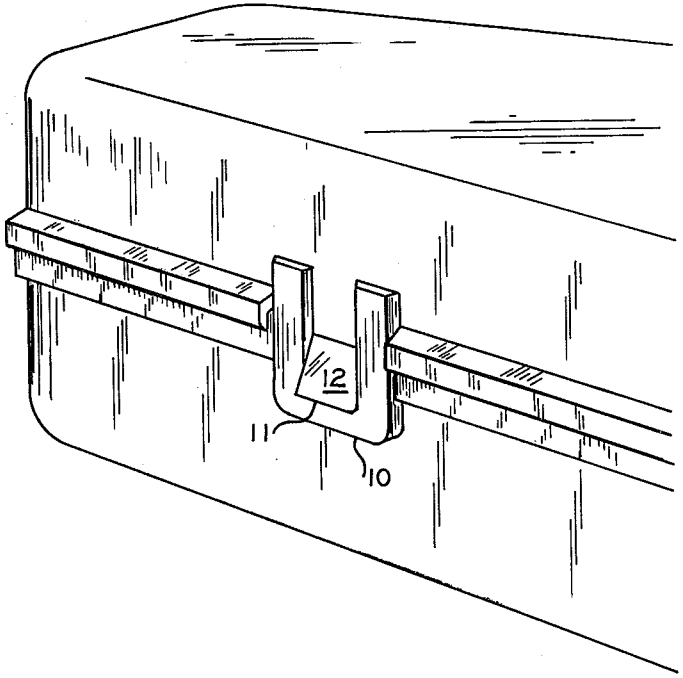
FIG. 4 shows the hasp and wedge arrangement providing the closure for the molded carrying case.
Figure 3:
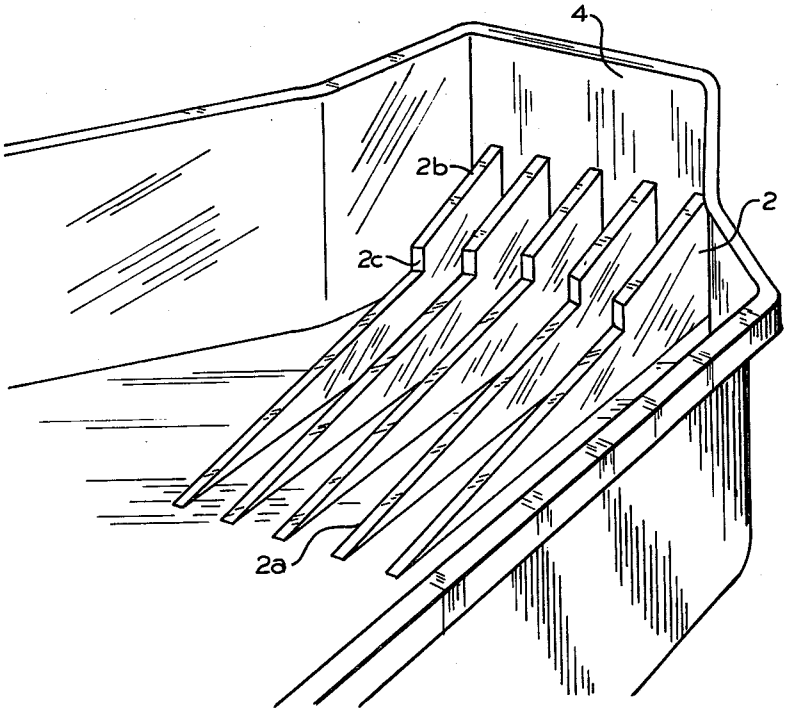
FIG. 3 is a modification of FIG. 2 in that the upstanding ribs providing the inclined surface or surfaces and/or offset, jog or crotch is shown in the cover.

Referring now to FIG. 4 it will be seen that the hasp 10 fits over wedge 11, it being forced outwardly by plane 12 until the hasp has been lowered so that the bail thereof snaps into position, espousing the base of the substantially triangularly shaped wedge.

As shown the wedge 11 is integrally molded into the bottom portion of the carrying case. As now preferred the top or apex edge of the wedge merges into the top edge of the wall of the bottom of the carrying case.

The hasp is molded integrally with the wall of the top of the carrying case and its flexibility as well as that of the wall permit the hasp to be forced outwardly by the plane 12 of the wedge.

One skilled in the art in possession of the concepts of this invention upon the reading of the specification and study of the disclosure, drawing and the claims will understand that modification and variation are possible without departing from the essential or basic concepts given.

Reasonable variation and modification are possible within the scope of the foregoing disclosure, drawing and the appended claims to the invention the essence of which is that there has been provided a carrying case preferably structured to fit more than one size of the same or similar type of object having as a basic concept of its design a stop against which a portion of the carried object is urged by the action of the weight of the object against an inclined plane generally facing the stop and urging the object toward said stop; the inclined plane being provided by at least one rib or upstanding or outcropping rib; the rib in a now preferred form having at least one offset therein; it being within the scope of the foregoing to provide a plurality of ribs and/or stops in combination; including placing a rib as described in the top of the carrying case and/or in the bottom thereof; and that a closure hasp and wedge arrangement integrally molded in the carrying case top and bottom, respectively, have been provided.

I claim:

1. A case adapted to receive and to store an object within it in a fixed position, thus preventing undesirable motion of that object in said case, which comprises in said case a stop, lug or block protruding from a wall of said case into its interior so positioned and adapted as to coact with a portion of said object that motion of that object toward said block is arrested when said portion of said object is in contact with a portion of said block, and an inclined surface within the interior of said case removed from said stop to provide between said surface and said stop a space to receive at least a portion of said object, said surface facing said portion of said stop and being otherwise so positioned and adapted as to coact with another portion of said object to urge it by virtue of its weight upon said inclined surface toward said portion of said stop.

2. A case according to claim 1 wherein the stop is upstanding from the bottom of said case and the inclined surface is formed by the edge of at least one upstanding, outcropping member or rib.

3. A case according to claim 1 wherein the inclined surface is formed with at least one offset, jog or crotch therein to adapt it to coact with a similar portion of said object when said portion of said object is complementarily formed to fit against said offset, jog or crotch.

4. A case according to claim 3 wherein the inclined surface is formed having at least two offsets, jogs or crotches at different distances from said stop so that said surface and the offset jog or crotch near to said stop will fix a certain sized object and the more removed offset jog or crotch will fix an object of larger than said certain size object.

5. A case according to claim 1 wherein said stop is formed as a bay or stall to receive into said bay a portion of said object thus to fix said portion within said bay with the coaction of said inclined surface when the object has been placed upon said surface.

6. A case according to claim 1 wherein the case is molded and the stop and inclined surface providing upstanding, outcropping member or rib are integrally molded in a wall of said case.

7. A case according to claim 2 wherein a plurality of outcropping members or ribs are provided.

8. A case according to claim 3 wherein a plurality of outcropping members or ribs provide a plurality of inclined surfaces, each surface is formed with at least one offset, jog or crotch therein and wherein the offsets, jogs or crotches in at least two of said inclined surfaces are at different distances from said stop to accommodate at least two objects of different models or sizes.

9. A case according to claim 8 wherein there are provided identical pairs of inclined surfaces removed from each other to support and to urge said portion of said object toward said stop in a balanced manner.

10. A case according to claim 1 wherein the object is a portable chain saw having gripping teeth the stop is adapted to receive at least one of the gripping teeth of said saw, and wherein at least one inclined surface and any offset, jog or crotch therein is adapted to receive and to coact with a portion of said chain saw body.

11. A case according to claim 10 wherein said stop and said upstanding outcropping or rib are in the bottom of said case when said case is in upright position.

12. A case according to claim 10 wherein said stop is in the bottom of said case and wherein said upstanding outcropping or rib is in the top of said case when said case is in upright position.

13. A case according to claim 12 wherein said case has a top or closure member and a bottom or carrying member and wherein the upstanding outcropping or rib fits snugly against a portion of the chain saw body in close position of said closure member, thus to urge said teeth against said stop by acting against said portion of said chain saw body.

14. A case according to claim 10 wherein a plurality of inclined surfaces are provided, at least two of which are possessed of at least two offsets, jogs or crotches at different distances from said stop to permit said case to accommodate two different sized or models of saw.

15. A case according to claim 14 wherein there are provided facing generally towards said stop four upstanding ribs disposed substantially in parallel alignment and spaced from each other, the two outer most or first and fourth rib being possessed of an offset, jog or crotch and being identically shaped, the second and third rib being identical to each other but having the offset, jog or crotch at a distance more remote from that of the first and fourth rib.

16. A case according to claim 15 wherein there is provided a fifth rib positioned between said second and third rib having an offset, jog or crotch therein more remote from those of the second and third rib.

17. A case according to claim 1 wherein there is provided in said case removed from said stop and from said inclined surface generally also faced by said surface a centering lug.

* * * * *